US005141417A

United States Patent [19]

Bush

[11] Patent Number: 5,141,417

[45] Date of Patent: Aug. 25, 1992

[54] METHOD FOR DYNAMICALLY BALANCING NESTED COUPLING MECHANISMS FOR SCROLL MACHINES

[75] Inventor: James W. Bush, Skaneateles, N.Y.

[73] Assignee: Carrier Corporation, Syracuse, N.Y.

[21] Appl. No.: 808,820

[22] Filed: Dec. 17, 1991

[51] Int. Cl.[5] ..... F01C 1/04; F01C 17/06

[52] U.S. Cl. ..... 418/1; 418/55.3

[58] Field of Search ..... 418/1, 55.3, 55.5, 57

[56] References Cited

U.S. PATENT DOCUMENTS 3,874,827 4/1975 Young ..... 418/55.5

*Primary Examiner*—John J. Vrablik

[57] ABSTRACT

Co-orbiting scroll members are maintained in a fixed angular relationship. Each of the scroll members coacts with a common anti-rotation structure which controls orbiting motion between the scroll member. A second anti-rotation structure limits one of the scroll members to orbiting motion with respect to the crankcase. The scroll members orbit in orbits of different radii.

1 Claim, 3 Drawing Sheets

METHOD FOR DYNAMICALLY BALANCING NESTED COUPLING MECHANISMS FOR SCROLL MACHINES

BACKGROUND OF THE INVENTION

In a scroll machine such as a pump, compressor or expander there is one basic coaction between the scroll elements in that one must orbit with respect to the other. The scroll element orbiting with respect to the other scroll element is generally called the orbiting scroll. In known designs both scroll elements are rotating, both are orbiting, one is fixed or is only capable of axial movement. A design where both scroll elements orbit, but at different radii, is exemplified by U.S. Pat. No. 3,874,827 which discloses a number of embodiments. Specifically, in FIG. 15, a version of a co-orbiting scroll design is disclosed in which two Oldham couplings are used. One is keyed between the scrolls but is located within the scroll elements. Basically, however, the disclosed embodiments have a driven major-/orbiting scroll which has a fixed orbit and which, in turn, drives a driven scroll which is able to move in a minor/smaller orbit as well as axially. The driven scroll is acted on by discharge pressure which forces the driven scroll into axial engagement with the driving scroll as well as a resilient material member which tends to locate the driven scroll at a position corresponding to the center of the minor orbit. The driven scroll moves in an orbiting motion subject to the bias of the resilient material which may make the orbit non-circular. In the disclosed embodiments, the compressor is of the open drive type with the motor above the scrolls.

SUMMARY OF THE INVENTION

The present invention is directed to a scroll machine having two orbiting scrolls. Two Oldham couplings are nested below the major/orbiting scroll. The coupling which is keyed between the scrolls is located nearest the major scroll and has all four keys on the same side of the coupling. The other coupling, which is keyed between the major scroll and crankcase, is located near the crankcase. In both couplings, one set of keys must extend around some component to engage in the appropriate slots. A minor scroll coacts with the inner surface of a pilot ring which guides and supports the minor scroll in its movement through its minor orbit to thereby provide radial compliance. Intermediate pressure acts on the minor scroll to provide an axial compliance force to maintain the minor and major/orbiting scrolls in engagement. The major/orbiting scroll rides on the crankcase. The crankcase, pilot ring and separator plate are bolted together and hold the major and minor scroll as well as the anti-rotation structure therebetween.

In scroll compressors having an Oldham coupling or other reciprocating anti-rotation device, the reciprocating unbalance can, at best, be counterbalanced by only one half by using rotating counterweights. In the case of the co-orbiting scroll design of the present invention, there are two separately reciprocating Oldham couplings to balance.

It is an object of this invention to couple two components in a fixed angular relationship while allowing one component, the minor scroll, to orbit with respect to the other member, the major scroll.

It is a further object of this invention to counteract most, if not all, of the reciprocating unbalance of the anti-rotation structure through the use of rotating counterweights.

It is another object of this invention to provide a co-orbiting scroll machine which maintains a fixed angular relationship between the two orbiting members. These objects, and others as will become apparent hereinafter, are accomplished by the present invention.

Basically, a scroll machine is provided with co-orbiting scroll members which are maintained in a fixed angular relationship. Each of the scroll members coacts with anti-rotation structure and is located within an assembly defined by a separator plate, pilot ring and crankcase which are secured together. The anti-rotation structure is in the form of two nested Oldham-type couplings which are located between the crankcase and the major scroll. The coactions of the two couplings is such as to produce the effect of a rotating unbalance which serves to counteract the reciprocating unbalance. The rotating unbalance may be fully balanced with conventional rotational counterweights.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
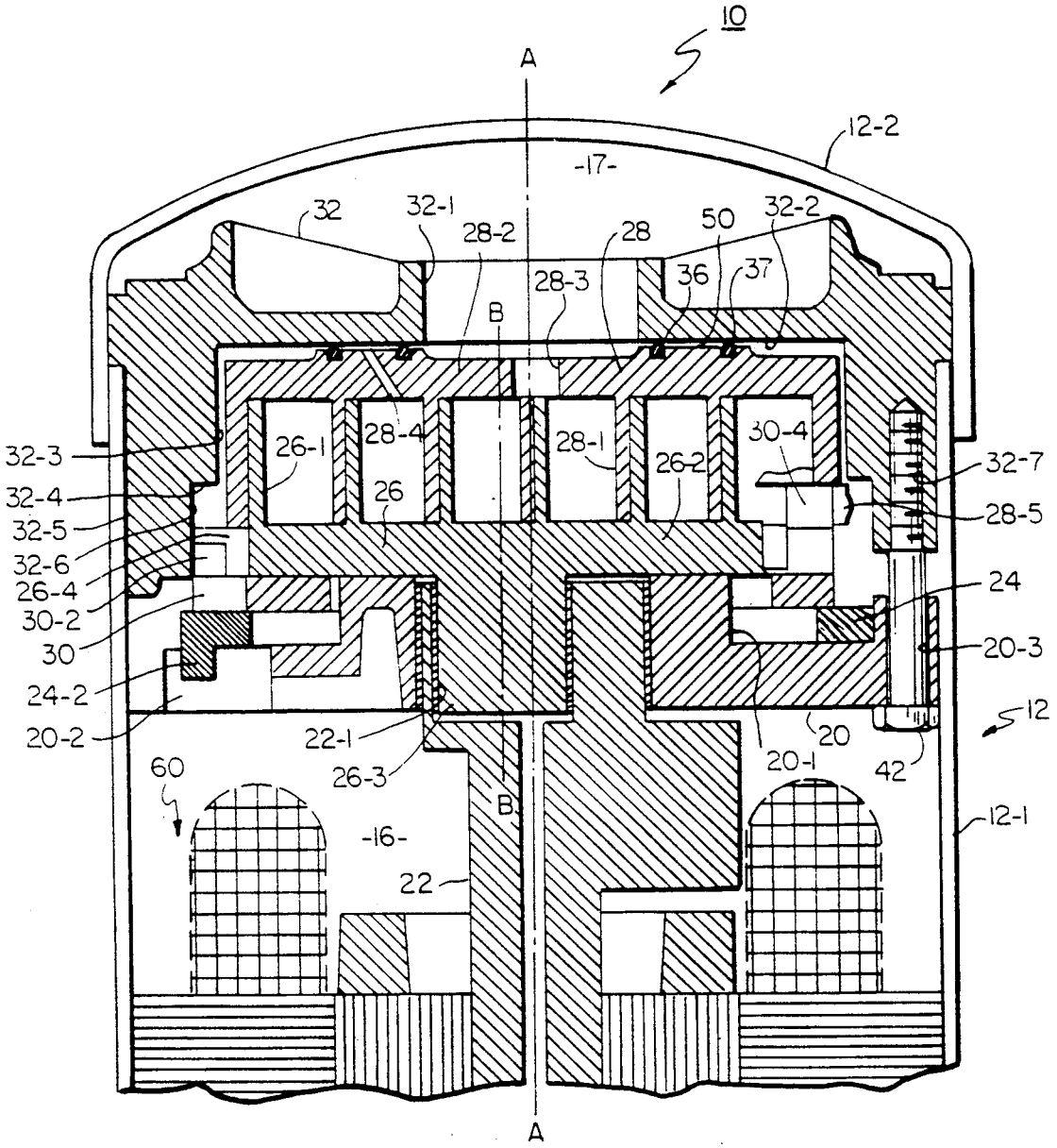
FIG. 1 is a partial, vertical sectional view of a scroll compressor employing the present invention.
Figure 2:
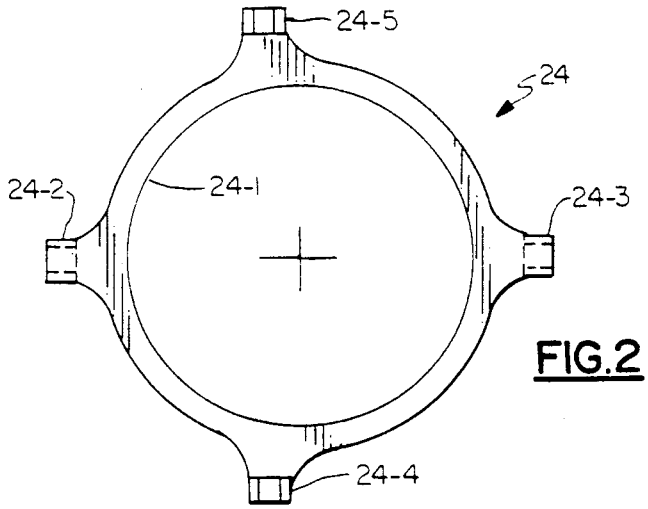
FIG. 2 is a top view of a first coupling member.

In FIG. 1, the numeral 10 generally designates a low side hermetic scroll compressor. Compressor 10 has a shell or casing 12 having a main body 12-1 with an upper cover 12-2. Separator plate 32 divides the shell 12 into a suction plenum 16 and a discharge plenum 17. A crankcase 20 is welded or otherwise suitably secured within main body 12-1 and supports crankshaft 22 and Oldham coupling 24 in a conventional manner. Crankshaft 22 receives hub 26-3 of major or driving scroll 26 in eccentrically located recess 22-1. Major or driving scroll 26 is supported by crankcase 20 and coacts with Oldham coupling 24 in a conventional manner. Crankshaft 22 drives major or driving scroll 26 at a fixed radius. Major or driving scroll 26 has a wrap 26-1 which coacts with wrap 28-1 of minor or driven scroll 28. A second Oldham coupling 30 is nested between first Oldham coupling 24 and major scroll 26. It should be noted that in FIG. 1, the Oldham couplings 24 and 30 are illustrated to show a single key and adjacent keys rather than the paired keys. Referring initially to FIG. 2, it will be noted that Oldham coupling 24 is of a generally conventional design other than for having one pair of taller than normal keys. Specifically, there are two pairs of keys generally diametrically located with respect to bore 24-1. In order to reduce dimensional requirements, a pair of keys may be located other than on a diameter of bore 24-1, as illustrated for the overlying keys. One pair of keys is located on each side of coupling 24 with the diameters of the respective pairs being located at right angles. As viewed in FIG. 2, only keys 24-4 and 24-5 are visible and they are diametrically offset, as illustrated.

Figure 3:
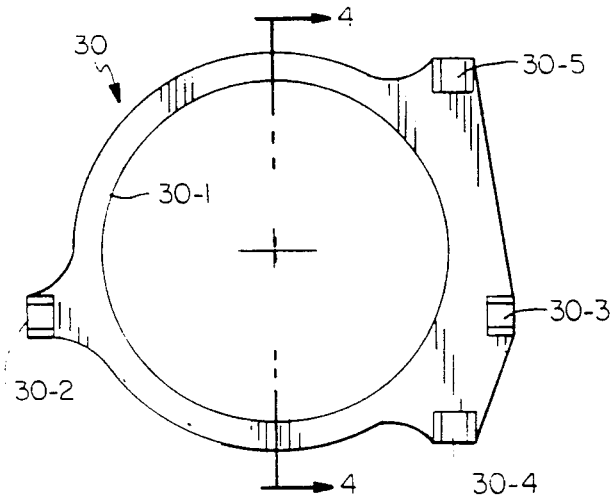
FIG. 3 is a top view of a second coupling member.
Figure 4:
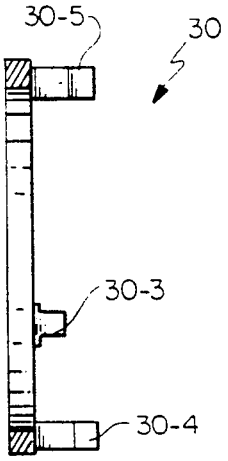
FIG. 4 is a sectional view taken along line 4—4 of FIG. 3.
Figure 5:
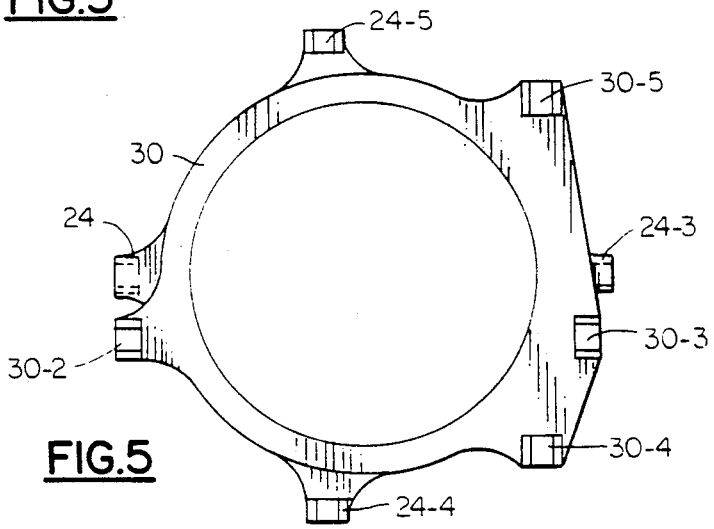
FIG. 5 is a top view showing the coupling of FIG. 3 overlying the coupling of FIG. 2.

Referring now to FIGS. 3 and 4, it will be noted that Oldham coupling 30 differs from conventional designs in that it is asymmetrical, all of the keys are on the same side of coupling 30 and the pairs of keys are of different heights. Specifically, coupling 30 has a bore 30-1, opposed short keys 30-2 and 30-3, and opposed tall keys 30-4 and 30-5. Referring now to FIG. 5, it will be noted that keys 24-4, 24-5 and 30-2 through 30-5 are visible and all extend upwardly relative to coupling 30.

Major scroll 26, minor scroll 28 and Oldham couplings 24 and 30 are held in place between crankcase 20 and separator plate 32. Specifically, as illustrated, separator plate 32 has a discharge passage 32-1 extending between discharge port 28-3 and discharge plenum 17. Annular surface 32-2 surrounds discharge passage 32-1 and is engaged by annular 0-rings or other suitable seals 36 and 37 carried by minor scroll 28. Bore 32-3 has an axial extent corresponding to the major portion of the axial extent of minor scroll 28 whereby bore 32-3 defines a pilot ring or surface. Shoulder 32-4 surrounds bore 32-3. Circumferentially spaced legs 32-5 extend from shoulder 32-4 and their inner surfaces 32-6 provide a greater diametrical clearance than bore 32-3. Pilot ring 32-3 surrounds scrolls 26 and 28. Minor scroll 28 has a base 28-2 and inner and outer annular recesses are formed in the surface of base 28-2 and receive 0-rings or other suitable seals 36 and 37, respectively. One or more restricted fluid passages 28-4 extend through base 28-2 from a point located between seals 36 and 37 and a point located between adjacent turns of wrap 28-1.

In assembling compressor 10, starting with crankcase 20, coupling 24 is placed over central annular projection 20-1 such that there is a clearance between bore 24-1 and projection 20-1. Key 24-2 is placed in slot 20-2 and an aligned key (not illustrated) on coupling 24 is placed in an aligned slot (not illustrated) in crankcase 20. Coupling 30 is then placed over central annular projection 20-1 such that there is a clearance between bore 30-1 and projection 20-1. As best shown in FIG. 5, when coupling 30 is placed onto coupling 24, as described, keys 24-4 and 24-5 are located radially outwardly of coupling 30 and are of a height/axial extent such that they extend above coupling 30. Major/orbiting scroll 26 is set in place such that keys 24-4 and 24-5 are received in slots (not illustrated). The coaction between crankcase 20, coupling 24, and major scroll 26 is conventional for a scroll compressor and differs structurally only in the increased height of keys 24-4 and 24-5 due to the presence of coupling 30 and, if desired or necessary, the shifting of the keys from a diameter to reduce their spacing and the resultant space requirements for the movement of coupling 24.

Additionally, when major/orbiting scroll 26 is set in place, short keys 30-2 and 30-3 are located in corresponding slots on the back of base 26-2, with only slot 26-4 which receives key 30-2 being illustrated. Minor scroll 28 is then set in place with wrap 28-1 being operatively located with respect to wrap 26-1. Also, corresponding slots formed in minor scroll 28 are located so as to operatively receive tall keys 30-4 and 5, with only slot 28-5 which receives key 30-4 being illustrated. Seals 36 and 37 are located in corresponding grooves formed in the back of base 28-2. Separator plate 32 is placed such that minor scroll 28 is received in bore 32-3, and couplings 24 and 30 are received within the space defined by legs 32-5. Corresponding sets of bores 32-7 and 20-3 are aligned and bolts 42 are threaded thereinto. The resultant pump structure may then be secured in main casing 12-1. When so assembled, major scroll 26 is capable of orbital movement in a circle having a radius equal to the distance between A—A the axis of crankshaft 22 and B—B the axis of hub 26-3. Scroll 28 is capable of orbital movement through a circle having a diameter equal to the difference in diameters of bore 32-3 and base 28-2.

In operation, a motor 60 drives crankshaft 22 causing it to rotate about its axis A-A carrying eccentrically located hub 26-3 of major scroll 26. Because major scroll 26 coacts with Oldham coupling 24, major scroll 26 is held to an orbiting motion when driven by crankshaft 22 with the radius of the orbit being equal to the distance between axes A—A and B—B. Wrap 26-1 of major scroll 26 coacts with wrap 28-1 of minor scroll 28 to trap volumes of gas from suction plenum 16 and compress the gas with the resultant compressed gas passing serially through discharge port 28-3 and discharge passage 32-1 into discharge plenum 17 from which the compressed gas passes to the refrigeration system via an outlet (not illustrated). As the gas is being compressed the resultant pressure results in a force acting on scrolls 26 and 28 tending to separate them axially and radially. Radial movement of minor scroll 2 is limited by base 28-2 coacting with the inner annular surface of bore 32-3 which acts as a pilot ring. Additionally, coupling 30 coacts with both major scroll 26 and minor scroll 28 to limit radial movement of minor scroll 28 to an orbiting motion relative to major scroll 26. Because the difference in diameters of base 28-2 and bore 32-3 determines the diameter of the orbit of minor scroll 28, it is possible for the diameter of orbit of scroll 28 to be designed to be increased and made equal to or greater than the orbit of scroll 26, if necessary or desired. Axial separation of scrolls 26 and 28 is limited by annular surface 32-2 of separator plate 32 which is bolted to crankcase 20 by bolts 42. Axial separation of scrolls 26 and 28 is opposed by fluid pressure in annular chamber 50. Annular chamber 50 is located between separator plate 32 and minor scroll 28 with its inner boundary defined by seal 36 and its outer boundary defined by seal 37. Chamber 50 is in fluid communication with a location at an intermediate pressure in the compression process via one or more fluid passages 28-4. As a result, the pressure in chamber 50 axially forces minor scroll 28 into axial engagement with major scroll 26.

To summarize the operation, major scroll 26 is driven in a fixed orbiting motion. Responsive to the fluid pressure of the compression process, base 28-2 of minor scroll 28 is forced into engagement with pilot surface 32-3 and maintains engagement thereby being limited in radial movement while being held to an orbiting motion relative to major scroll 26 by the coaction of coupling 30 with major scroll 26 and minor scroll 28. Minor scroll 28 is held in axial engagement with major scroll 26 by fluid pressure in chamber 50.

Figure 6:
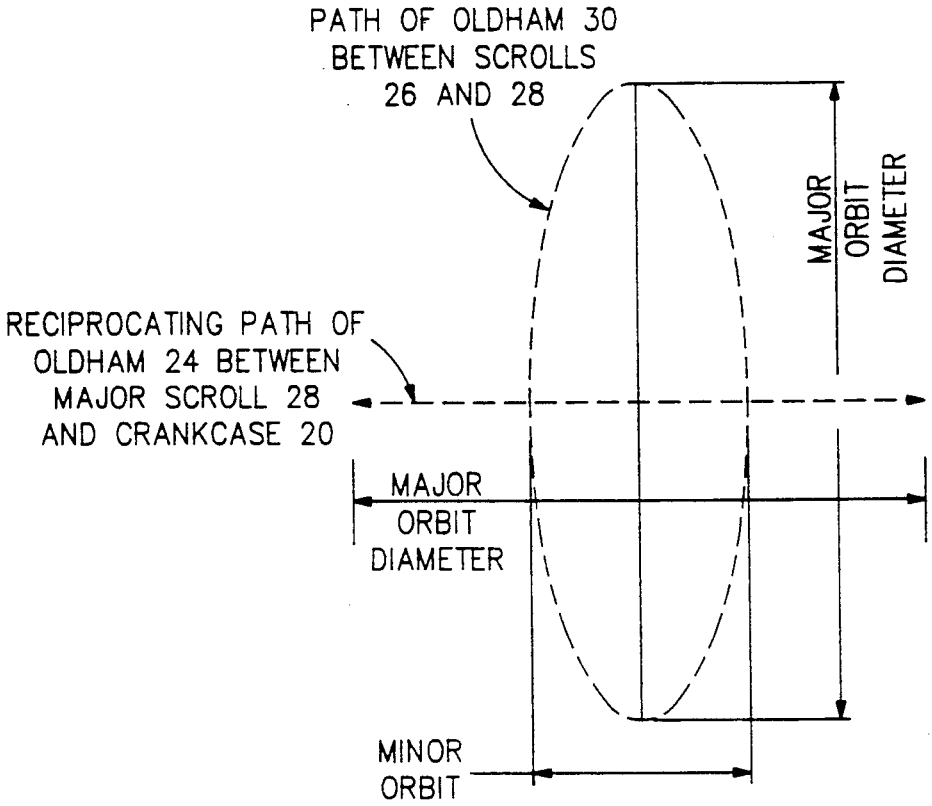
FIG. 6 is a mass displacement diagram for the anti-rotation couplings of the present invention.

From the foregoing description it should be readily evident that Oldham coupling 24 undergoes a reciprocating motion with respect to the fixed crankcase 20. Because Oldham coupling 24 only reciprocates while the scroll 26 orbits, there is an unbalance. However, Oldham coupling 30 undergoes a reciprocating motion with respect to scroll 26 which is orbiting and the mass-displacement path of Oldham coupling 30 between scrolls 26 and 28 is shown in FIG. 6. It will be noted that the mass-displacement path of Oldham coupling 30 between scrolls 26 and 28 is essentially an ellipse with a major axis approximately equal to the major orbit diameter and a minor axis approximately equal to the minor orbit diameter. If the difference in diameter between bore 32-3 and base 28-2 is changed, as noted above, the shape of the ellipse defining the mass-displacement path of Oldham coupling 30 can be changed.

Figure 7:
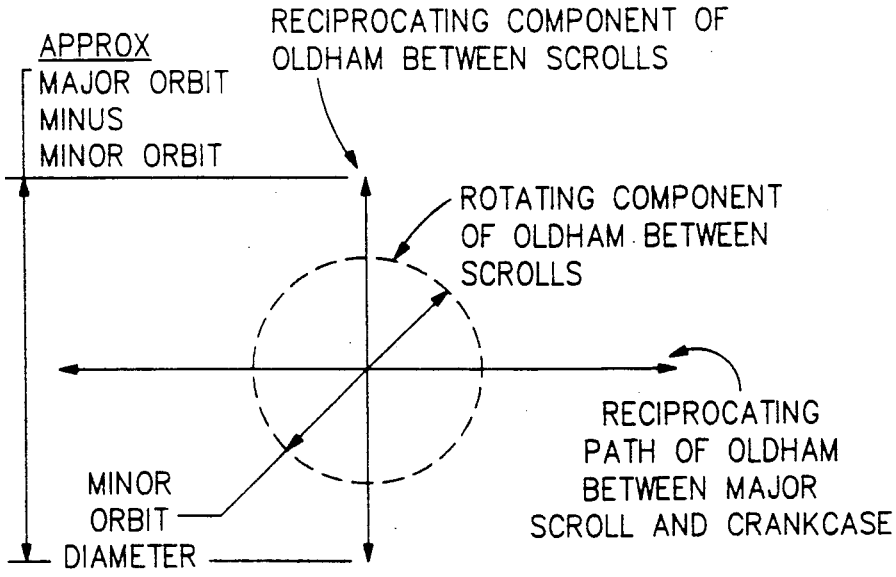
FIG. 7 is a combination of a rotating mass unbalance and a sinusoidally reciprocating mass according to the teachings of the present invention.

The displacement of coupling 30 may be approximated as a combination of a rotating mass unbalance and a sinusoidally reciprocating mass as shown in FIG. 7. The displacement of coupling 24 is purely linear with a sinusoidal motion. The key slots, of which only 20-2, 26-4 and 28-5 are illustrated, are placed such that the two reciprocating components of motion are essentially at right angles and moving 90° out of phase. The masses of the respective Oldham elements 24 and 30 are sized in inverse proportion to their reciprocating displacement components so that the total mass-displacements of each coupling are the same. As a result, the two components combine to produce the equivalent of a rotating mass unbalance which may be fully balanced with conventional rotational counterweights. Also, the pairs of aligned keys of the couplings 24 and/or 30 may intersect at an angle other than 90°. Specifically, an alignment of up to 10° from perpendicular could be made to also work effectively with only a small residual unbalance.

Although a preferred embodiment of the present invention has been illustrated and described, other changes will occur to those skilled in the art. For example, the location of the keys may be changed to change a diametrical movement to a chordal movement to reduce the size requirements. It is therefore intended that the scope of the present invention is to be limited only by the scope of the appended claims.

What is claimed is:

1. A method for dynamic balancing dual couplings comprising the steps of:

keying a first coupling between a first scroll member and a stationary crankcase whereby displacement of said first coupling is purely linear with a sinusoidal motion;

keying a second coupling between said first scroll member and a second scroll member whereby displacement of said second coupling is essentially elliptical;

locating the keyslots for said couplings such that reciprocating components of said displacements of said first and second couplings are within 10° of being at right angles and moving correspondingly within 10° of being 90° out of phase; and sizing the masses of said first and second couplings in inverse proportion to their reciprocating displacement components whereby the total mass-displacements of said first and second couplings are the same and produce a rotary force whereby the couplings may be balanced by rotating counterweights.

* * * * *